US010236595B2

(12) United States Patent
Yamamoto et al.

(10) Patent No.: US 10,236,595 B2
(45) Date of Patent: Mar. 19, 2019

(54) TERMINAL FITTING WITH A PLURALITY OF WIRE CONNECTION PORTIONS

(71) Applicant: Yazaki Corporation, Minato-ku, Tokyo (JP)

(72) Inventors: Takatatsu Yamamoto, Makinohara (JP); Keiichi Mita, Makinohara (JP); Ryou Suzuki, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/980,138

(22) Filed: May 15, 2018

(65) Prior Publication Data

US 2018/0351267 A1 Dec. 6, 2018

(30) Foreign Application Priority Data

Jun. 2, 2017 (JP) ..... 2017-110179

(51) Int. Cl.

| | |
|---|---|
| ***H01R 4/48*** | (2006.01) |
| ***H01R 11/32*** | (2006.01) |
| ***H01R 4/18*** | (2006.01) |
| ***H01R 4/34*** | (2006.01) |

(52) U.S. Cl.

CPC ..... *H01R 4/48* (2013.01); *H01R 4/185* (2013.01); *H01R 4/34* (2013.01); *H01R 11/32* (2013.01)

(58) Field of Classification Search

CPC . H01R 4/48; H01R 4/185; H01R 4/34; H01R 11/32; H01R 11/12; H01R 11/09; H01R 11/287; H01R 12/57

USPC ... 439/816, 97, 98, 100, 108–110, 368, 500, 439/850–855

See application file for complete search history.

(56) References Cited

U.S. PATENT DOCUMENTS

| | | | | |
|---|---|---|---|---|
| 7,125,295 | B2 * | 10/2006 | Zhao | H01R 11/12 439/883 |
| 8,105,121 | B2 * | 1/2012 | Miyamoto | H01R 4/646 439/883 |
| 9,153,880 | B2 * | 10/2015 | Omori | H01R 4/64 |
| 9,748,716 | B2 * | 8/2017 | Uehara | H01R 4/185 |
| 9,825,375 | B2 * | 11/2017 | Naganishi | H01R 4/185 |
| 9,859,627 | B2 * | 1/2018 | Yamamoto | H01R 4/185 |
| 2005/0003703 | A1 | 1/2005 | Ono et al. | |
| 2012/0302089 | A1 * | 11/2012 | Shuey | H01R 11/07 439/386 |
| 2014/0206223 | A1 * | 7/2014 | Saitou | H01R 4/64 439/386 |

FOREIGN PATENT DOCUMENTS

| | | |
|---|---|---|
| JP | 2003-178824 A | 6/2003 |
| JP | 2003-203687 A | 7/2003 |

* cited by examiner

*Primary Examiner* — Harshad C Patel

(74) *Attorney, Agent, or Firm* — Sughrue Mion, PLLC

(57) ABSTRACT

A terminal fitting includes a fastening portion and a wire connection portion. The fastening portion is formed with an installation insertion hole through which a fixing member is inserted. The wire connection portion extends from a peripheral edge portion of the fastening portion. A notch is provided in the fastening portion so as to extend along the peripheral edge of an opening of the installation insertion hole and between the installation insertion hole and the wire connection portion. A through hole or a thin recessed portion is formed on the notch at an intersection portion between the notch and an axis in an extending direction of the wire connection portion.

4 Claims, 6 Drawing Sheets

TERMINAL FITTING WITH A PLURALITY OF WIRE CONNECTION PORTIONS

CROSS REFERENCE TO RELATED APPLICATIONS

This application is based on Japanese Patent Application (No. 2017-110179) filed on Jun. 2, 2017, the contents of which are incorporated herein by way of reference.

BACKGROUND

The present invention relates to a terminal fitting.

In a related art, as a terminal fitting, one terminal fitting has been known which includes a metal fitting body which has a plate shape and includes a wire caulking portion (a wire connection portion) to be caulked to a wire and a fastening portion (a fastening portion) which is coupled to the metal fitting body via a breakable breakage portion (an easy fracture portion), and includes an insertion hole through which a fastener (a fixing member) such as a bolt is inserted to be fastened to a mating member (see JP-A-2003-178824 and JP-A-2003-203687, for example).

In this way, according to the terminal fitting in which the fastening portion and the wire connection portion are integrally formed and the easy fracture portion is provided between the fastening portion and the wire connection portion, the easy fracture portion is broken by pulling up the wire connected to the wire connection portion at the time of disassembling, and thus the wire connection portion side can be removed from the mating member in a state where the insertion hole side of the fastening portion remains in the mating member.

Therefore, the wire can be removed from the mating member without removing the bolt by breaking the easy fracture portion to remove the wire connection portion side. As a result, recyclability can be improved.

SUMMARY

A connection structure of a terminal fitting according to the invention is characterized by a terminal fitting including: a fastening portion formed with an installation insertion hole through which a fixing member is inserted; and a wire connection portion extending from a peripheral edge portion of the fastening portion, wherein a notch is provided in the fastening portion so as to extend along the peripheral edge of an opening of the installation insertion hole and between the installation insertion hole and the wire connection portion, and a through hole or a thin recessed portion is formed on the notch at an intersection portion between the notch and an axis in an extending direction of the wire connection portion.

A plurality of wire connection portions extend from the peripheral edge portion of the fastening portion so as to protrude in a radial direction of the installation insertion hole. Further, the wire connection portion includes a terminal connection portion which is integrally formed with the fastening portion so as to protrude from the peripheral edge portion of the fastening portion, and a connecting terminal which includes a fastening connection portion caulked to the terminal connection portion and is connected to a wire terminal. At least one of both ends of the notch in an extending direction thereof is continuous to the peripheral edge portion of the fastening portion.

BRIEF DESCRIPTION OF DRAWINGS

FIGS. 5A and 5B are enlarged perspective views illustrating main parts of the terminal fitting illustrated in FIG. 3, wherein FIG. 5A illustrates an end of a notch formed to be continuous to a peripheral edge portion of the fastening portion and FIG. 5B illustrates a through hole formed at the intersection portion of the notch intersecting with the axis in an extending direction of a wire connection portion.

DETAILED DESCRIPTION OF EXEMPLIFIED 5 EMBODIMENTS

In the terminal fitting disclosed in JP-A-2003-178824 and JP-A-2003-203687 as described above, a large force is required to break the easy fracture portion depending on a pulling direction in which the wire is pulled to break the easy fracture portion and remove the wire connection portion side. Thus, there is a possibility that the easy fracture portion cannot be broken and the recyclability deteriorates.

The invention has been made in view of the circumstances described above and an object thereof is to provide a terminal fitting capable of easily separating wires at the time of disassembling and improving recyclability.

Hereinafter, an example of a terminal fitting according to an embodiment of the present invention will be described with reference to accompanying drawings.

Figure 1:
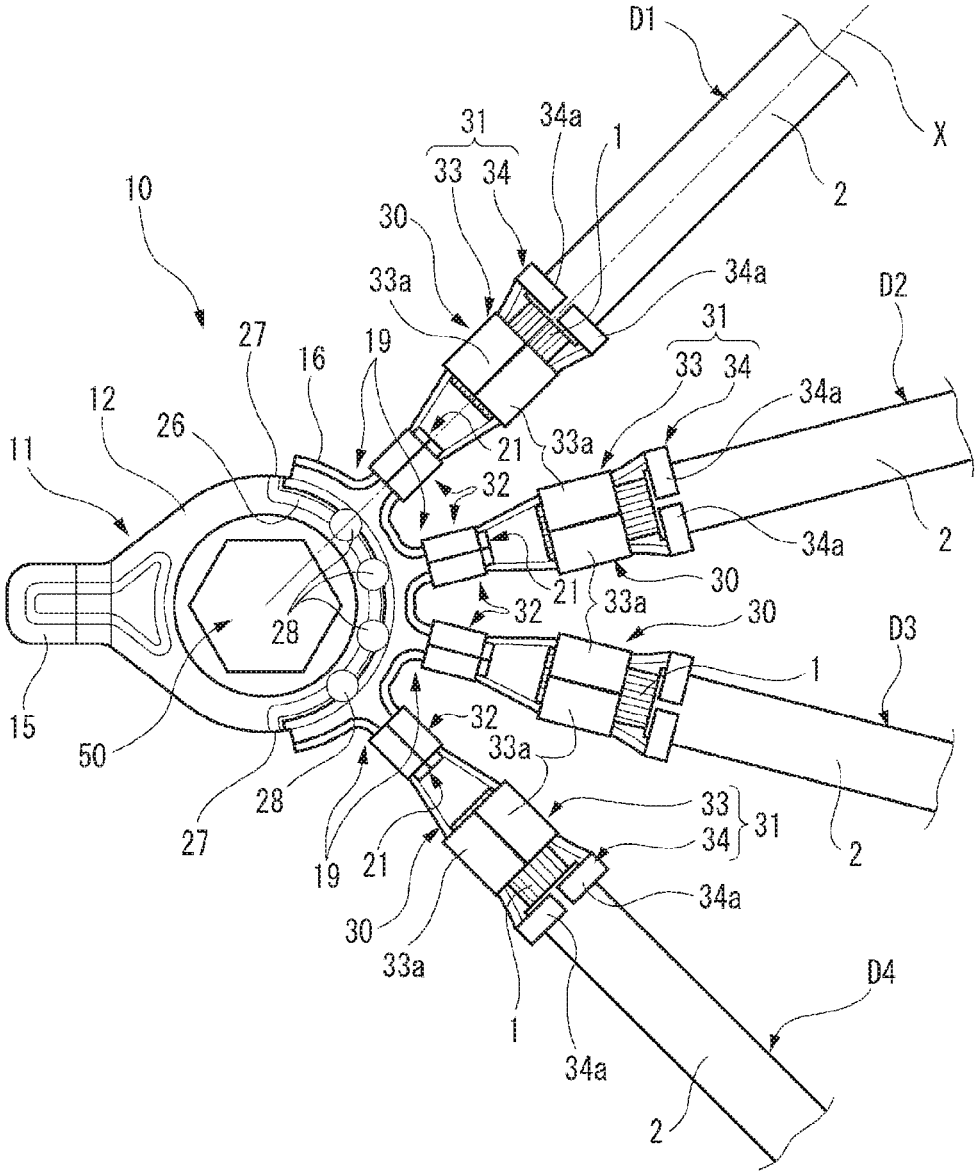
FIG. 1 is a plan view illustrating a state where a wire is connected to a terminal fitting according to an embodiment of the invention.
Figure 2:
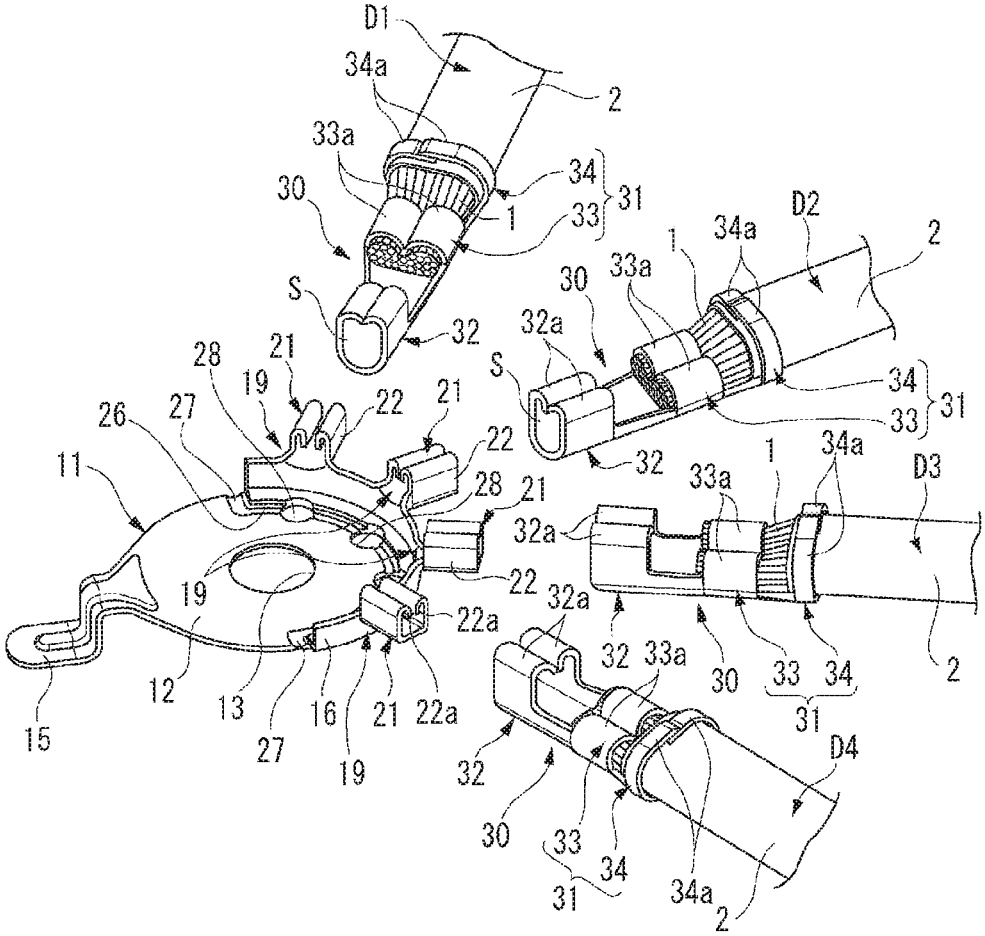
FIG. 2 is an exploded perspective view of a fastening portion and a connecting terminal in the terminal fitting illustrated in FIG. 1.
Figure 3:
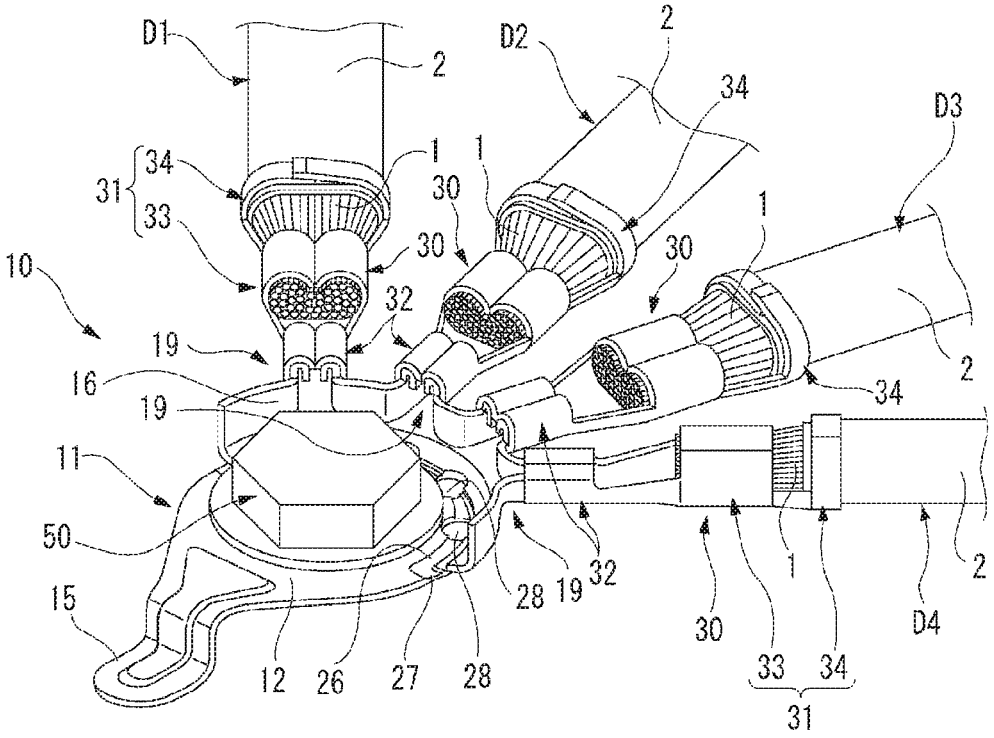
FIG. 3 is a perspective view of the terminal fitting illustrated in FIG. 1.

FIG. 1 is a plan view illustrating a state where wires D1 to D4 are connected to a terminal fitting 10 according to an embodiment of the invention and FIG. 2 is an exploded perspective view of a terminal body 11 and a connecting terminal 30 in the 20 terminal fitting 10 illustrated in FIG. 1.

As illustrated in FIG. 1, a plurality of (four in this example) wires D1 to D4 are connected to the terminal fitting 10 according to the embodiment. The terminal fitting 10 of the embodiment is electrically connected to the ground contact surface of a vehicle body or the like. The wires D1 to D4 connected to the terminal fitting 10 are grounding wires of an in-vehicle circuit (auxiliary). The wires D1 to D4 have a conductor portion 1 and an outer sheath 2 covering the conductor portion 1. In the wire terminal connected to the terminal fitting 10, the conductor portion 1 is exposed from the outer sheath 2. In the wires D1 to D4, the conductor portion 1 is connected to the terminal fitting 10. As a result, the wires D1 to D4 5 of the in-vehicle circuit and the ground contact surface of a vehicle body and the like are conducted via the terminal fitting 10.

As illustrated in FIG. 2, the terminal fitting 10 of the embodiment includes a fastening portion 12 in which an installation insertion hole 13 is formed and a terminal body 11 in which a plurality of terminal connection portions 21 which constituting a wire connection portion 19 together with a connecting terminal 30 connected to the wire terminal are formed. In other words, the wire connection portion 19 of the embodiment is constituted of a plurality of terminal connection portions 21 which are integrally formed so as to protrude from the peripheral edge portion of the fastening portion 12 and a connecting terminal 30 which is caulked and fastened to each terminal connection portion 21.

The terminal body 11 in the terminal fitting 10 is a press-molded product of a conductive metal plate. The terminal body 11 includes the fastening portion 12 having a circular shape in a plan view. In this fastening portion 12, an installation insertion hole 13 having a circular shape is formed in the center. The terminal body 11 is fixed to the ground contact surface of a vehicle body or the like by a bolt (a fixing member) 50 which passes through the installation setting hole 13 of the fastening portion 12. It should be noted that the installation setting hole 13 may be provided eccentrically rather than at the center of the fastening portion 12. In addition, a washer may be interposed between the fastening portion 12 and the bolt 50. Further, instead of the bolt 50, other fixing members such as rivets can be used.

An anti-rotation piece 15 is formed in a part of the fastening portion 12. The anti-rotation piece 15 is a bent portion that engages with a stepped portion or a hole portion around the ground contact surface to which the fastening 5 portion 12 is fastened. The anti-rotation piece 15 engages with the stepped portion or the hole portion around the ground plane, so that the anti-rotation piece restricts the rotation of the terminal fitting 10 with respect to the ground contact surface.

A supporting wall portion 16 having a semicircular arc shape in a plan view is formed on the peripheral edge of the fastening portion 12. The supporting wall portion 16 stands on the upper surface side which is one surface side with respect to the fastening portion 12.

A plurality of terminal connection portions 21 are provided in the upper end of the supporting wall portion 16. Specifically, four terminal connection portions 21 are formed in the supporting wall portion 16. In the same plane, the terminal connection portions 21 protrude and extend radially from the supporting wall portion 16 which is the peripheral edge portion of the fastening portion 12. In other words, the wire connection portion 19 according to the embodiment extends from the peripheral edge portion of the fastening portion 12 in a radial direction of the installation insertion hole 13.

Figure 5A:
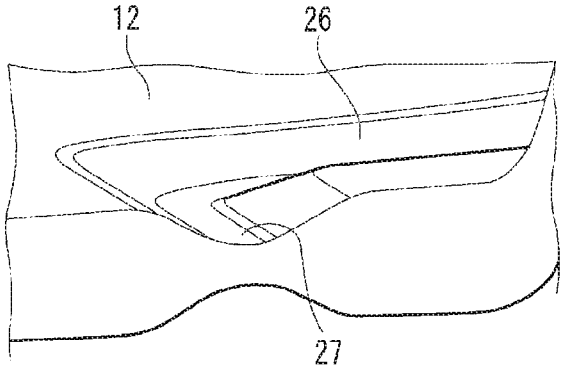
Figure 5B:
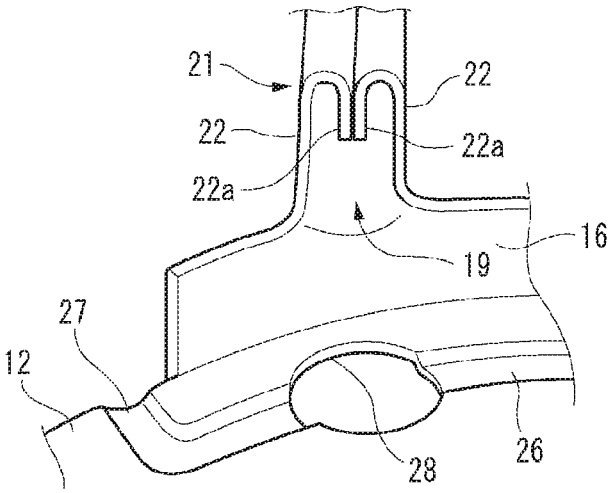

In each terminal connection portion 21, engaging walls 22 which are fastened caulked pieces protruding to the upper surface side which is one surface side are provided on both sides. As a result, the respective terminal connection portions 21 are formed in a U shape as viewed from the front. Further, in the engaging wall 22, engaging pieces 22*a* which are curved inwardly in a circular arc shape and folded back are provided in the upper ends (see FIG. 5B).

As illustrated in FIGS. 1 and 2, a notch 26 and a through hole 28 constituting an easy fracture portion which can be broken at the time of disassembling are provided in a portion between the installation setting hole 13 of the fastening portion 12 and the plurality of wire connection portions 19.

The notch 26 which extends in the semicircular arc shape along the opening peripheral edge of the installation insertion hole 13 in the terminal body 11 and along the supporting wall portion 16 is a groove having a V-shaped cross section formed on the front and back surfaces so that the wall thickness of the fastening portion 12 becomes smaller than that of the other portions. In addition, both ends 27 at both ends in the extending direction of the notch 26 extending in a semicircular arc shape are formed so as to be continuous with the peripheral edge portion of the fastening portion 12 (see FIG. 5A).

The through hole 28 is a circular though hole which is formed to penetrate the terminal body 11 in the thickness direction at the intersection portion of the notch 26 intersecting with an axis X in the extending direction of the terminal connection portion 21 in each wire connection portion 19. Therefore, four through holes 28 are arranged according to the four terminal connection portions 21 to which the wires D1 to D4 are respectively connected. The through hole 28 is not limited to a circular opening but may be an elliptical or polygonal opening.

The notch 26 and the through hole 28 can be simultaneously formed at the time of press working or the like.

The connecting terminal 30 includes a wire connecting portion 31 and a fastening connection portion 32. The wires D1 to D4 are connected to the wire connecting portions 31. The connecting terminal 30 provided in each of the wires D1 to D4 is a press-molded product of a conductive metal plate. The fastening connection portion 32 is caulked to the terminal connection portion 21 of the fastening portion 12, so that the fastening connection portion is fastened. The wire transmitting portion 31 includes a conductor caulking portion 33 and a sheath caulking portion 34.

The conductor caulking portion 33 is formed in a U shape having a pair of conductor caulking pieces 33*a*. The conductor portions 1 of the respective wires D1 to D4 are caulked and fixed to the conductor caulking portion 33 by caulking the conductor caulking pieces 33*a*. As a result, the conductor portions 1 of the respective wires D1 to D4 and the connecting terminals 30 are conducted.

The sheath caulking portion 34 is formed in a U shape having a pair of sheath caulking pieces 34*a*. The leading ends of outer sheaths 2 of the respective wires D1 to D4 are caulked and fixed to the sheath caulking portion 34 by caulking the sheath caulking pieces 34*a*.

To connect the respective wires D1 to D4 to the connecting terminals 30, the outer sheaths 2 are removed at the ends of the wires D1 to D4 and the conductor portions 1 are exposed. Next, the ends of the wires D1 to D4 are placed on the wire connecting portions 31 of the connecting terminals 30, and then the conductor caulking portion 33 is caulked and the sheath caulking portion 34 is caulked. Therefore, the respective wires D1 to D4 are electrically connected to the connecting terminals 30.

The fastening connection portion 32 of the connecting terminal 30 includes a pair of fastening caulking pieces 32*a*. The fastening caulking pieces 32*a* are raised upward from the terminal bottom portion, respectively. In the fastening caulking pieces 32*a*, the upper ends are curved inwardly in a circular arc shape and folded back.

Therefore, in the fastening connection portion 32 of the 5 connecting terminal 30, a holding space S surrounded by the fastening caulking pieces 32*a* is formed. Both side surfaces of the holding space S are formed as substantially vertical surfaces by the fastening caulking pieces 32*a* raised upward.

The holding space S of the fastening connection portion 32 is slightly larger than the outer shape of the terminal connection portion 21 as viewed from the front. Therefore, the terminal connection portion 21 can be inserted into the holding space S. In addition, when the terminal connection portion 21 is inserted into the holding space S, the terminal connection portion 21 abuts against both side faces forming the holding space S, so that the rotation of the terminal connection portion 21 about the axis line along the insertion direction of the terminal connection portion 21 to the holding space S is restricted.

Furthermore, the fastening connection portion 32 in which the terminal connection portion 21 is inserted in the holding space S is caulked by crushing the fastening caulking piece 32*a* by a crimping machine (not illustrated). In this case, the fastening caulking piece 32*a* is caulked so as to involve both side portions of the terminal connection portion 21 and to involve the engaging wall 22 of the terminal connection portion 21 and the engaging piece 22*a* at the upper end of the engaging wall from the outside. As a result, the engaging wall 22 having the engaging piece 22*a* is rounded inside the fastening caulking piece 32*a* and is accommodated without a gap and the terminal connection portion 21 is filled in the fastening connection portion 32. Therefore, the fastening connection portion 32 is firmly caulked and fastened to the terminal connection portion 21 with a high contact pressure and the terminal connection portion 21 of the terminal fitting 10 and the connecting terminal 30 are reliably electrically connected.

The terminal body 11 is fixed to the ground plane of a vehicle body or the like by a bolt 50 which is inserted through the installation setting hole 13 of the fastening portion 12, so that the terminal fitting 10 can electrically connect the wires D1 to D4 of the in-vehicle circuit and the ground plane of the vehicle body or the like. According to the terminal fitting 10 of the embodiment, a plurality of wire connection portions 19 are provided radially on the peripheral edge portion of the fastening portion 12. Therefore, it is possible to provide numbers of wire connection portions 19 while the area to be occupied in the terminal fitting 10 is reduced as much as possible, and thus it is possible to allow a plurality of wires D1 to D4 to be connected at once.

In a state where the wires D1 to D4 are fastened to the vehicle body by the terminal fitting 10 according to the invention, when the wires D1 to D4 are grasped and pulled at the time of disassembling of a vehicle, the pulling force reaches a predetermined value (for example, 500 N). Therefore, the notch 26 which is an easy fracture portion provided between the terminal connection portion 21 of the wire connection portion 19 and the fastening portion 12 breaks. As a result, the fastening portion 12 which is fastened to the body of a vehicle with a bolt and the four wire connection portions 19 to which the four wires D1 to D4 are connected are separated from one another. In other words, the supporting wall portion 16 forming the four terminal connection portions 21 is separated from the fastening portion 12.

Figure 4:
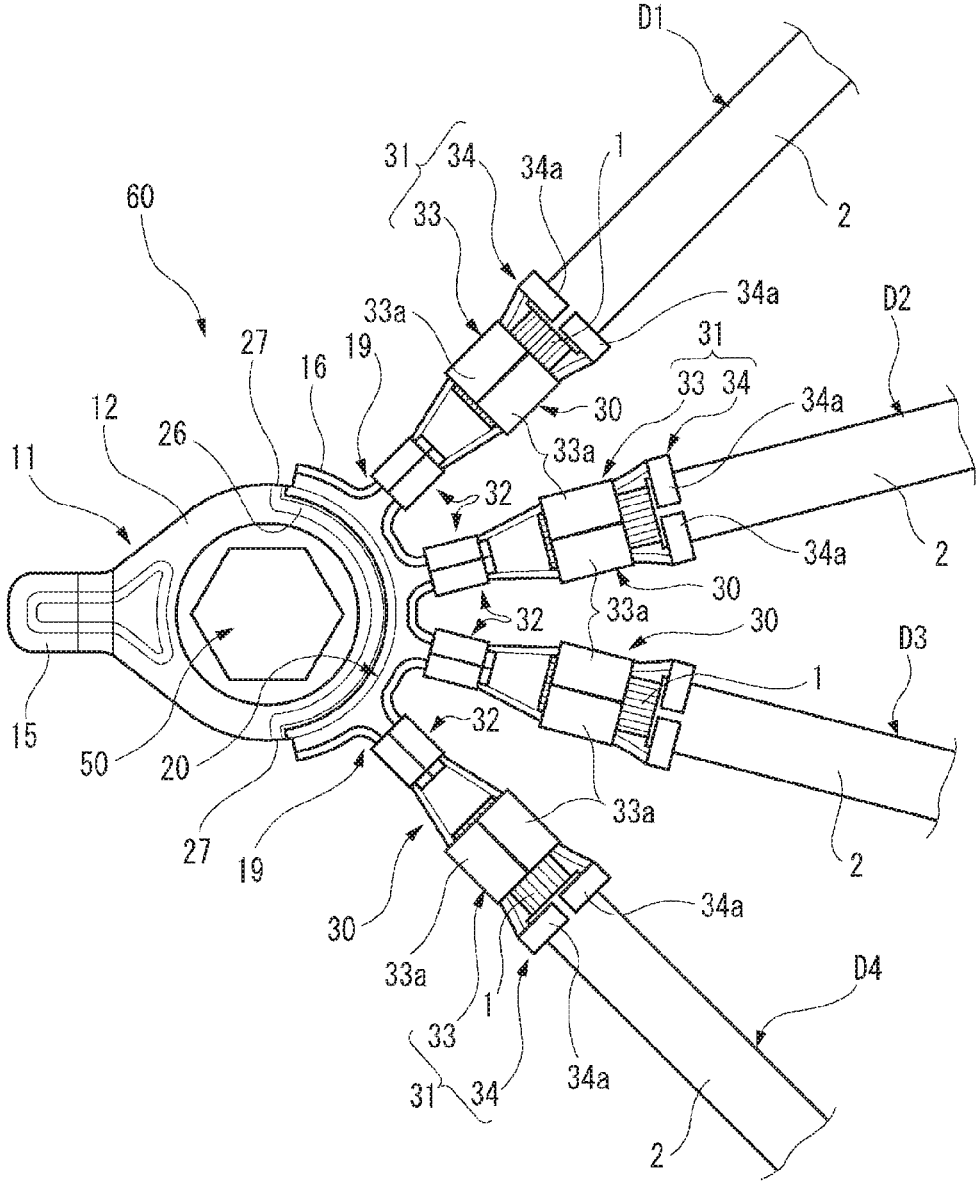
FIG. 4 is a plan view illustrating a state where the wire is connected to a terminal fitting according to a reference example.

However, as in the terminal fitting 60 according to a reference example illustrated in FIG. 4, when only the notch 26 is provided as the easy fracture portion provided between the fastening portion 12 and the wire connection portion 19, it is not possible to easily break the notch 26 depending on the wire pulling direction. When the wires D1 and D2, for example, are pulled at the same time, the wire D1 on the outer side sticks out, and thus it is difficult for the stress to be concentrated on the end 27 of the notch 26 acting as the cutting start point. As a result, a tensile load greater than that at the time of pulling the wired D2 and D3 at the same time is required.

On the contrary, in the terminal fitting 10 according to the embodiment, a through hole 28 is formed at the intersection portion of the notch 26 intersecting with the axis X in the extending direction of the terminal connection portion 21 in each wire connection portion 19. When at least one of the wires D1 to D4 connected to the terminal connection portion 21 is pulled up at the time of disassembling, the fastening portion 12 is bent at the notch 26 and the through hole 28 is formed at the intersection portion of the notch 26 which intersects with the axis X in the extending direction and where the tensile stress from the wire is concentrated. Therefore, the through hole 28 in which the tensile stress from the wire is concentrated acts as the cutting start point, and thus it is possible to make the notch 26 easy to break.

As described above, according to the terminal fitting 10 of the embodiment, an easy fracture portion provided between the fastening portion 12 and the wire connection portion 19 is constituted of the notch 26 which extends along the peripheral edge of the opening of the installation setting hole 13 and the through hole 28 which is formed in the intersection portion of the notch 26 intersecting with the axis X in the extending direction of the wire connection portion 19.

In this case, when the wires D1 to D4 connected to the wire connection portions 19 are pulled up at the time of disassembling, first, the fastening portion 12 is folded at the notch 26 provided between the installation insertion hole 13 and the wire connection portion 19. Furthermore, a through hole 28 is formed at the intersection portion of the notch 26 where the axes X in the extending direction of the wire connection portions 19 to which the wires D1 to D4 are connected intersect therewith and the tensile stress from the wires D1 to D4 is concentrated. Therefore, the through hole 28 where the tensile stress from the wires D1 to D4 is concentrated acts as the cutting start point, and thus notch 26 tends to be cut easily. As a result, it is possible to reduce the tensile force necessary for breaking the easy fracture portion of terminal fitting 10 at the time of disassembling, and thus recyclability can be improved.

In the terminal fitting 10 according to the embodiment, a plurality of wire connection portions 19 are provided radially on the peripheral edge portion of the fastening portion 12. Therefore, it is possible to provide numbers of wire connection portions 19 while the area to be occupied in the terminal fitting 10 is reduced as much as possible, and thus a plurality of wires D1 to D4 can be connected at once.

In this case, at the time of disassembling, the through holes 28 which are respectively formed at the intersection portions of notch 26 intersecting with the axes X in the extending direction of the respective wire connection portions 19 act as cutting start points. Therefore, even in any wire pulling direction, the notch 26 can 13 be broken easily, and thus a plurality of wires D1 to D4 can be separated from fastening portion 12 at once.

In the terminal fitting 10 according to the embodiment, the fastening connection portions 32 of the connecting terminals 30 connected to the wire terminals are caulked to the plurality of terminal connection portions 21 provided in the terminal fitting 10, so that the connecting terminal 30 can be fastened to the terminal fitting 10 and a plurality of wires D1 to D4 can be electrically connected to the terminal fitting 10 at once.

In this case, the terminal fitting 10 has a structure where separate connecting terminals 30 are caulked and fastened to the terminal fitting 10. Thus, the connecting terminals 30 connected with wires D1 to D4 of different sizes can be caulked, fastened and electrically connected to the terminal connection portion 21. In other words, it can deal with wires of various sizes without changing the connection form between the terminal connection portion 21 of the terminal fitting 10 and the fastening connection portion 32 of the connecting terminal 30.

In the embodiment described above, the wire connection portion 19 is constituted of the terminal connection portions 21 which are integrally formed so as to protrude from the peripheral edge portion of the fastening portion 12 and the connecting terminal 30 which includes the fastening connection portion 32 which is caulked and fastened to the terminal connection portion 21 and is connected to the wire terminal. However, the wire connection portion of the invention is not limited thereto. For example, it may be constituted of a wire crimping portion which protrudes from the peripheral edge portion of the fastening portion 12 so as to be integrally formed and is crimped to the wire terminal.

In the terminal fitting 10 according to the embodiment, both ends 27 in both ends in the extending direction of the notch 26 extending along the peripheral edge of the opening of the installation insertion hole 13 is formed to be continuous to the peripheral edge portion of the fastening portion 12. In this case, when the wires D1 to D4 connected to the wire connection portion 19 are pulled along the peripheral edge of the opening of the installation insertion hole 13 at the time of disassembling, the end 27 of notch 26 acts as the cutting start point. As a result, the notch 26 is easily cut. Furthermore, the notch 26 can be easily broken even with the tensile force in any direction of wires D1 to D4, and thus the wires D1 to D4 can be more easily separated from the fastening portion 12. In this embodiment, both ends 27 of the notch 26 are formed to be continuous to the peripheral edge portion of the fastening portion 12. However, the invention is not limited thereto. At least one end 27 of both ends in the extending direction of the notch 26 may be formed to be continuous to the peripheral edge portion of the fastening portion 12.

Figure 6:
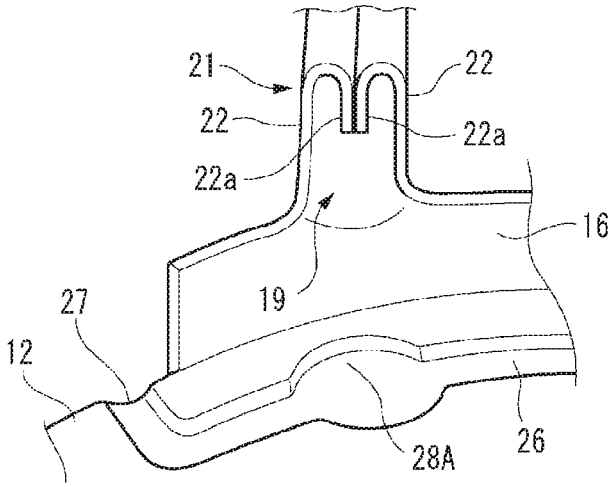
FIG. 6 is an enlarged perspective view illustrating main parts of a terminal fitting according to a modified example in which a thin recessed portion is formed in place of the through hole of the terminal fitting illustrated in FIG. 5B.

As shown in a modification example illustrated in FIG. 6, a thin recessed portion 28A can also be formed at the intersection portion of the notch 26 intersecting with the axis X in the extending direction of the wire connection portion 19. The thin recessed portion 28A is a circular weak recessed portion formed at the intersection portion of the notch 26 intersecting with the axis X in the extending direction of the terminal connection portion 21 in each wire connection portion 19. Four thin recessed portions 28A are arranged according to the four terminal connection portions 21 to which the wires D1 to D4 are respectively connected. It should be noted that the thin recessed portion 28A is not limited to a circular recessed portion but may be an oval or polygonal recessed portion.

As described above, according to the terminal fitting 10 of the embodiment, it is possible to easily separate a plurality of the wires D1 to D4 at the time of disassembling, so that recyclability can be improved.

Further, it is to be noted that the invention is not limited to the embodiment described above, but can be appropriately modified, improved, 5 or the like. In addition, materials, shapes, dimensions, numbers, placement locations, and the like of each component in the embodiment described above are arbitrary as far as the invention can be achieved and are not limited.

Here, the features of the embodiment of the terminal fitting according to the invention described above are summarized briefly in [1] to [4] described below.

[1] The terminal fitting (10) is characterized by including a fastening portion (12) formed with an installation insertion hole (13) through which a fixing member (a bolt 50) is inserted is formed; and a wire connection portion (19) extending from a peripheral edge portion of the fastening portion (12), wherein a notch (26) is provided in the fastening portion (12) so as to extend along the peripheral edge of an opening of the installation insertion hole (13) and between the installation insertion hole (13) and the wire connection portion (19), and a through hole (28) or a thin recessed portion (28A) is formed on the notch at an intersection portion between the notch (26) and an axis (X) in an extending direction of the wire connection portion (19).

[2] The terminal fitting (10) according to [1], wherein a plurality of wire connection portions (19) extend from the peripheral edge portion of the fastening portion (12) so as to protrude in a radial direction of the installation insertion hole 16 (13).

[3] The terminal fitting (10) according to [2], wherein the wire connection portion (19) includes a terminal connection portion (21) which is integrally formed with the fastening portion (12) so as to protrude from the peripheral edge portion of the fastening portion (12) and a connecting terminal (30) which includes a fastening connection portion (32) caulked to the terminal connection portion (21) and is connected to a wire terminal.

[4] The terminal fitting according to any one of [1] to [3], wherein at least one (27) of both ends of the notch (26) in an extending direction thereof is continuous to the peripheral edge portion of the fastening portion (12).

In the terminal fitting having the above configurations, the easy fracture portion which is provided in the portion between the fastening portion and the wire connection portion includes the notch which extends along the opening peripheral edge of the installation insertion hole and the through hole or thin recessed portion which is formed in the intersection portion of the notch intersecting with the axis in the extending direction of the wire connection portion.

In this case, when the wire connected to the wire connection portion is pulled up at the time of disassembling, first, the fastening portion is folded at the notch provided between the installation insertion hole and the wire connection portion. Furthermore, the through hole or the thin recessed portion is formed at the intersection portion of the notch where the axis in the extending direction of the wire connection portion connected with the wire intersects therewith and the tensile stress from the wire is concentrated. In this case, the through hole or the thin recessed portion where the tensile stress from the wire is concentrated acts as the cutting start point, and thus the notch tends to be cut easily. Therefore, it is possible to reduce the tensile force necessary for breaking the easy fracture portion of the terminal fitting at the time of disassembling, and thus recyclability can be improved.

In the terminal fitting having the above configurations, the plurality of wire connection portions are provided radially on the peripheral edge portion of the fastening portion. Therefore, it is possible to provide numbers of wire connection portions while the area to be occupied in the terminal fitting is reduced as much as possible, and thus a plurality of wires can be connected at once.

In this case, at the time of disassembling, the through holes or the thin recessed portions which are respectively formed at the intersection portions of notch intersecting with the axes in the extending direction of the respective wire connection portions act as cutting start points. Therefore, even in any wire pulling direction, the notch can be broken easily, and thus a plurality of wires can be separated from the fastening portion at once.

In the terminal fitting having the above configurations, the fastening connection portions of the connecting terminals connected to the wire terminals are caulked to the plurality of terminal connection portions provided in the terminal fitting, so that the connecting terminal can be fastened to the terminal fitting and a plurality of wires can be electrically connected to the terminal fitting at once.

In this case, the terminal fitting has a structure where separate connecting terminals are caulked and fastened to the terminal fitting. Thus, the connecting terminals connected with wires of different sizes can be caulked, fastened and electrically connected to the terminal connection portion. In other words, it can deal with wires of various sizes without changing the connection form between the terminal connection portion of the terminal fitting and the fastening connection portion of the connecting terminal.

In the terminal fitting having the above configurations, at least one end of both ends in the extending direction of the notch extending along the peripheral edge of the opening of the installation insertion hole is formed to be continuous to the peripheral edge portion of the fastening portion. In this case, when the wire connected to the wire connection portion is pulled along the peripheral edge of the opening of the installation insertion hole at the time of disassembling, the end of the notch acts as the cutting start point. As a result, the notch is easily cut. Furthermore, the notch can be easily broken even with the tensile force in any direction of wire, and thus the wire can be more easily separated from the fastening portion.

According to the invention, it is possible to provide the terminal fitting in which the wire can be easily separated at the time of disassembling and recyclability can be improved.

What is claimed is:

1. A terminal fitting comprising:

a fastening portion formed with an installation insertion hole through which a fixing member is inserted; and a wire connection portion extending from a peripheral edge portion of the fastening portion, wherein a notch is provided in the fastening portion so as to extend along the peripheral edge of an opening of the installation insertion hole and between the installation insertion hole and the wire connection portion, and a through hole or a thin recessed portion is formed on the notch at an intersection portion between the notch and an axis in an extending direction of the wire connection portion.

2. The terminal fitting according to claim 1, wherein a plurality of wire connection portions extend from the peripheral edge portion of the fastening portion so as to protrude in a radial direction of the installation insertion hole.

3. The terminal fitting according to claim 2, wherein the wire connection portion includes a terminal connection portion which is integrally formed with the fastening portion so as to protrude from the peripheral edge portion of the fastening portion, and a connecting terminal which includes a fastening connection portion caulked to the terminal connection portion and is connected to a wire terminal.

4. The terminal fitting according to claim 1, wherein at least one of both ends of the notch in an extending direction thereof is continuous to the peripheral edge portion of the fastening portion.

* * * * *